US009248641B2

(12) United States Patent
Gilan et al.

(10) Patent No.: US 9,248,641 B2
(45) Date of Patent: Feb. 2, 2016

(54) INK TRANSFER ELEMENT

(71) Applicants: Ziv Gilan, Kfar-harif (IL); Michal Kalish, Nes Ziona (IL); Zeharia Levi, Petach Tikva (IL); David Levi, Nes Ziona (IL)

(72) Inventors: Ziv Gilan, Kfar-harif (IL); Michal Kalish, Nes Ziona (IL); Zeharia Levi, Petach Tikva (IL); David Levi, Nes Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/443,595

(22) PCT Filed: Nov. 23, 2012

(86) PCT No.: PCT/EP2012/073439

§ 371 (c)(1),
(2) Date: May 18, 2015

(87) PCT Pub. No.: WO2014/079506

PCT Pub. Date: May 30, 2014

(65) Prior Publication Data

US 2015/0298453 A1 Oct. 22, 2015

(51) Int. Cl.
*B41J 2/01* (2006.01)
*B41J 2/005* (2006.01)

(52) U.S. Cl.
CPC ..... *B41J 2/0057* (2013.01)

(58) Field of Classification Search
CPC ..... B41J 2/0057
USPC ..... 347/103
See application file for complete search history.

(56) References Cited

U.S. PATENT DOCUMENTS

| | | | |
|---|---|---|---|
| 3,618,567 | A | 11/1971 | Levy |
| 3,797,388 | A | 3/1974 | Kaminstein |
| 5,573,883 | A | 11/1996 | Berkes |
| 5,758,237 | A | 5/1998 | Abramsohn |
| 5,937,249 | A | 8/1999 | Shin |
| 6,471,628 | B1 | 10/2002 | Hirayama |
| 7,597,439 | B2 | 10/2009 | Wexler et al. |
| 2009/0087211 | A1 | 4/2009 | Kadomatsu |

FOREIGN PATENT DOCUMENTS

WO WO-2012054054 A1 4/2012

OTHER PUBLICATIONS

Onishi, H. et al.; "Thermal Dissolution Ink Transfer for Full-color Printing"; Jan. 1993; pp. 69-74; vol. 40; Issue: 1; http://ieeexplore.ieee.org/stamp/stamp.jsp?arnumber=249426.

*Primary Examiner* — Stephen Meier
*Assistant Examiner* — Alexander D Shenderov

(57) ABSTRACT

An ink transfer element for a printing apparatus, the ink transfer element comprising a surface for transferring ink applied thereto to at least one further ink transfer element, wherein the surface is configured to, when an ink comprising pigment particles and a liquid vehicle is applied to the surface, at least partly separate the liquid vehicle from the pigment particles, through the surface. The ink transfer element further relates to printing apparatus and a method of printing.

15 Claims, 4 Drawing Sheets

INK TRANSFER ELEMENT

BACKGROUND

An example of a printing apparatus is a digital offset printing apparatus, such as the Hewlett Packard (HP) Indigo line of digital printing presses which are based on digital offset color technology. These presses combine ink-on-paper quality with multi-color printing on a wide range of paper, foil and plastic substrates, i.e. print media. These digital printing presses offer cost-effective short-run printing, on-demand service, and on-the-fly color switching.

A digital offset printing apparatus works by using digitally controlled lasers or LED imaging modules for example, to create a latent image in the charged surface of a photo-imaging cylinder. The lasers are controlled according to digital instructions from a digital image file. Digital instructions typically include one or more of the following parameters: image color, image spacing, image intensity, order of the color layers, etc. Ink is then applied to the partially-charged surface of the photo-imaging cylinder, recreating the desired image (or a single color separation of a color image). The image is then transferred from the photo-imaging cylinder to a heated blanket cylinder, and from the blanket cylinder to the desired substrate, which is placed into contact with the blanket cylinder by means of an impression cylinder.

It is known in printing apparatus, for example digital offset printers, to use at least one binary ink developer (BID) to electrostatically transfer ink to the photo-imaging cylinder. A BID may include a developer roller in contact with the photo-imaging cylinder, allowing ink to be electrostatically transferred from the BID to the cylinder.

In known printers, the liquidity of an ink for transfer to a photo-imaging cylinder can reduce a quality of image printed using the ink. Known printers may use a squeegee roller in contact with a developer roller to reduce the liquidity of the ink, however the effectiveness of this method is limited.

BRIEF DESCRIPTION OF THE DRAWINGS

The accompanying drawings illustrate examples of the principles described herein and are a part of the specification. The illustrated examples are merely examples and do not limit the scope of the claims.

DETAILED DESCRIPTION

In the following description, for purposes of explanation, numerous specific details are set forth in order to provide a thorough understanding of the present apparatus and methods. It will be apparent, however, to one skilled in the art that the present apparatus, systems and methods may be practised without these specific details. Reference in the specification to "an example" or similar language means that a particular feature, structure, or characteristic described in connection with the example is included in at least that one example, but not necessarily in other examples.

Examples described herein, and further examples which may be envisaged, relate to an ink transfer element for a printing apparatus, the ink transfer element comprising a surface for transferring ink applied thereto to at least one further ink transfer element, wherein the surface is configured to, when an ink comprising pigment particles and a liquid vehicle is applied to the surface, at least partly separate the liquid vehicle from the pigment particles, through the surface.

Figure 1A:
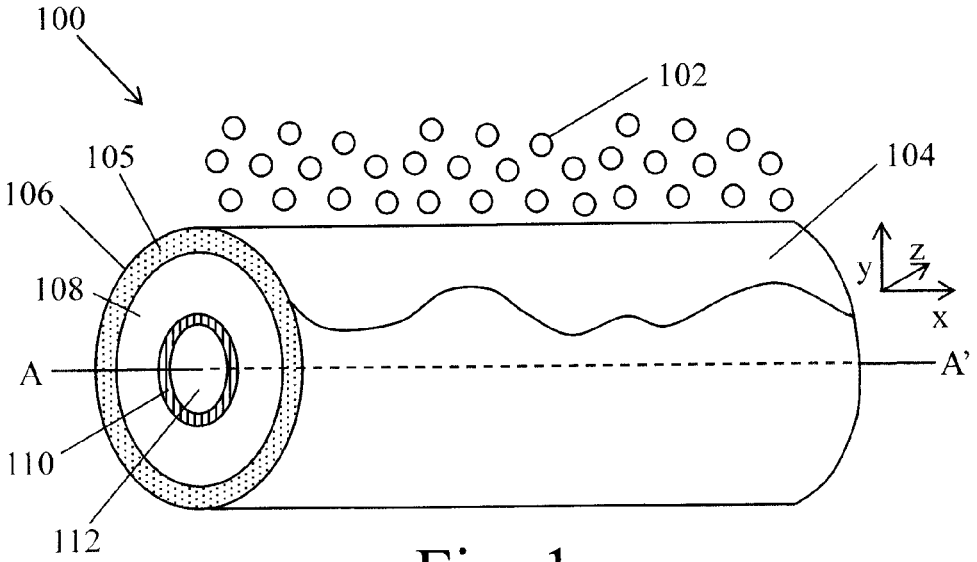
FIGS. 1*a* and 1*b* show schematically an example of an ink transfer element.
Figure 1B:
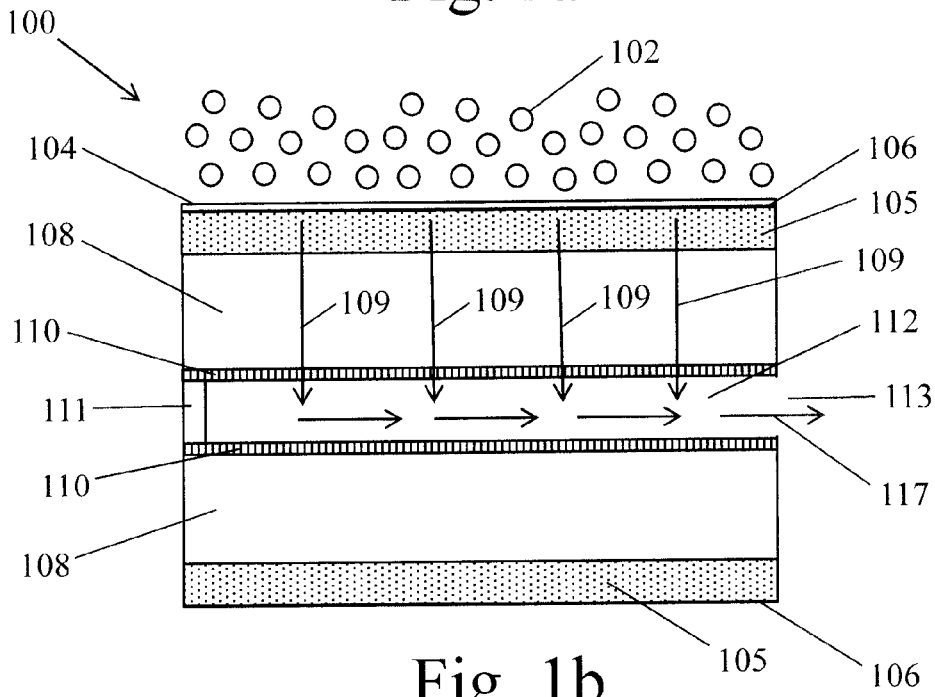

FIG. 1*a* is a diagram of an example of an ink transfer element. FIG. 1*b* shows a cross-sectional view of the example ink transfer element of FIG. 1*a* viewed in the x-y plane along the line A-A'.

According to this example, an ink transfer element (100) for a printing apparatus is provided, the ink transfer element (100) comprising a surface (106) for transferring ink (102) applied thereto to at least one further ink transfer element, such as a photo-imaging cylinder or developer roller described later. In this example, the ink transfer element (100) is a roller. In other examples, the ink transfer element may be of a different form, for example a belt or a plate.

The ink transfer element (100) in this example comprises a surface (106), wherein the surface (106) is an outer surface of a porous layer (105) forming an outer layer of the roller, and which in this example is electrically conductive. The porous layer (105) may, for example, be formed by a metallic mesh, a carbon fiber fabric layer, an electrically conductive coating, or an electrically conductive sponge layer. Appropriate materials would be known to the skilled person. For example, a suitable electrically conductive sponge layer may be formed of a material obtained from Building Manufacturing Partherships (BMP) America Inc., 11625 Maple Ridge Road, Medina, N.Y. 14103, USA, for example TransThane "CE"™. In other examples, the porous layer (105) may be formed of other materials which may or may not be electrically conductive.

In this example, the surface (106) may be deformable to an extent necessary to provide a close contact with at least one further ink transfer element such as a pressure roller or developer roller described later. However, in other examples, the surface (106) may be rigid.

The porous layer (105) in this example is arranged on at least one further porous layer, in this case one further layer (108) which may be formed of a sponge material and which may be electrically conductive for example. The layers (105), (108), may be supported by a core structure (110), which forms a liquid collector (112) described later. Alternatively, the ink transfer element (100) may be formed from a single layer of porous material on a core structure, or from a single porous material with a hollow core to form a liquid collector.

The surface (106) of the ink transfer element (100) is configured to, when an ink (102) comprising pigment particles and a liquid vehicle is applied to the surface (106), at least partly separate the liquid vehicle from the pigment particles, through the surface (106), thus leaving a layer of more solid ink (104) on the surface (106).

The ink in this example is a liquid electro-photographic ink, such as an ink from the Electrolnk range available from HP, 3000 Hanover Street, Palo Alto, Calif. 94304-1185, USA. Pigment particles are suspended in a liquid vehicle which in this example is Isopar Oil™ (available from ExxonMobil Corporation, 5959 Las Colinas Boulevard, Irving, Tex. 75039-2298), although it is envisaged that other liquid vehicles may be used. A diameter, for example a minimum, maximum, or average diameter, of pigment particles in an ink intended for application to the surface may be in the range of 1 to 20 microns, for example 5, 10, 15, or 20 microns. A pore size of the surface (106) may be 50 microns or less, for example in the range of 10 to 50 microns, and for example 10, 20, 30, 40, or 50 microns. In some examples the pore size of the surface (106) may be the same as or less than the diameter of the pigment particles, thus enabling separating of at least part of the liquid vehicle from the pigment particles through the surface. In other examples, the pore size of the surface (106) may be larger than the diameter of the pigment particles; in these examples, it has been found that at least part of the liquid vehicle may be separated from the pigment particles through the surface by aggregation of pigment particles on the surface. In such aggregation, a group of pigment particles may aggregate together over a pore of the surface, which aggregation of particles is larger than a pore size of the surface, thus preventing the pigment particles passing through the surface.

Thus, the surface is configured to separate at least some of the liquid vehicle from the pigment particles, for a given ink, through the surface (106). A pore size of the at least one porous layer (105), (108) may be the same as the surface pore size or may be greater or less, provided the pore size permits liquid vehicle to pass from the surface to the liquid collector. The pigment particles may be electrically charged or chargeable.

The liquid collector (112) at the center of the ink transfer element (100) is arranged to collect liquid vehicle separated at the surface (106) and having passed through the at least one layer (105), (108), and core structure (110) underlying the surface (106).

In this example, the core structure is a hollow cylinder which may be manufactured from a metallic or plastic material, for example aluminium. The walls of the cylinder are porous and/or have holes for the liquid vehicle of the ink to pass through. While in this example the layers of the ink transfer element (100) and liquid collector (112) are cylindrical, in other examples any of these elements may have a different shape than described.

The hollow of the cylinder forms the liquid collector (112) which in this example is closed at one end (111) and open at the other end (113) so liquid vehicle collected in the liquid collector (112) may flow out (117) of the liquid collector (112) via the open end (113), which open end may for example be formed as a drain for draining liquid vehicle out of the ink transfer element. Thus, the collected liquid vehicle may be drained, providing a simple and convenient way of removing the liquid vehicle for re-use or discarding, for example. In other examples, the liquid collector may be formed differently than described here.

In use, when an ink such as that described above is applied to the surface (106), it is separated into a more solid part (104) formed of pigment particles, which remains on the surface (106), and a more liquid part formed of liquid vehicle, which travels from the surface (106), through the porous layers (105), (108), and core layer (110), and into the liquid collector (112), as indicated by arrows (109) in FIG. 1*b*. This may be assisted by a pressure difference across the surface as described later.

As previously described, printing apparatus may use at least one binary ink developer (BID) to transfer ink to a photo-imaging cylinder. Two illustrative BIDs comprising examples of the ink transfer element will now be described, followed by an illustrative example of a printing apparatus.

Figure 2:
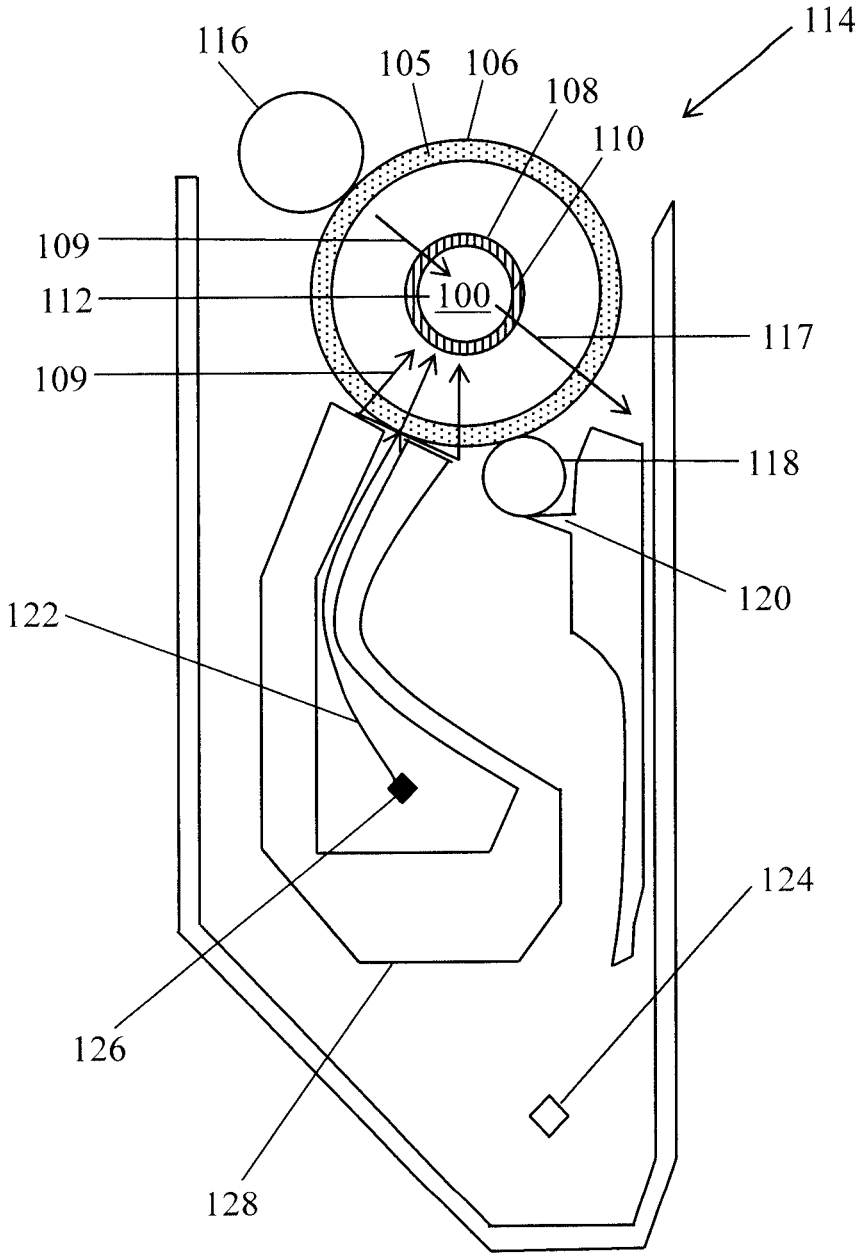
FIG. 2 shows schematically an illustrative binary ink developer (BID) comprising an ink transfer element in accordance with an example.
Figure 4:
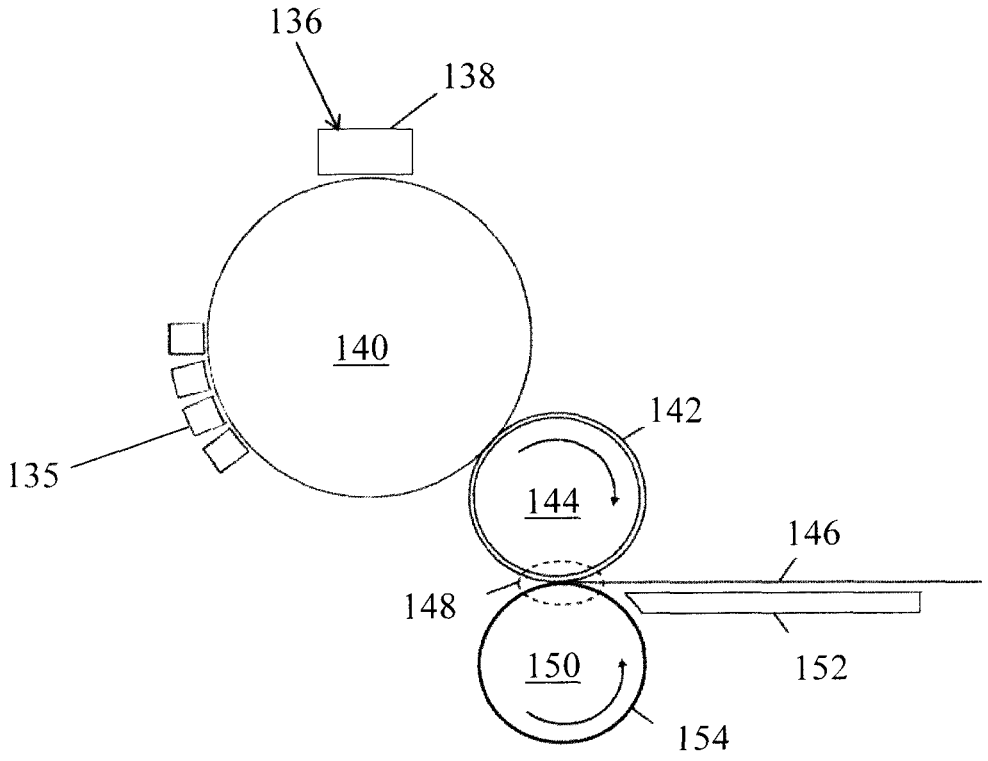
FIG. 4 shows schematically an illustrative printing apparatus according to an example.

FIG. 2 is a diagram of a first illustrative example of a BID (114) of a printing apparatus, such as the printing apparatus shown in FIG. 4. The BID comprises the ink transfer element (100) described using FIGS. 1*a* and 1 *b*. The printing apparatus comprises ink supply apparatus arranged for supplying ink to the ink transfer element (100) and at least one further ink transfer element (not shown) which is arranged to receive ink from the surface (106), such as a photo-imaging cylinder or a developer roller, using electrical force for example. In this example, the ink supply apparatus comprises an ink inlet (126) and electrodes (128) as part of the BID.

In this example, the ink for application to the surface of the ink transfer element (100) is positively or negatively charged and enters the BID through the ink inlet (126), for example from an ink reservoir. The charge of the ink is provided by charged pigment particles. In the example where the ink is positively charged, the electrodes (128) in this example are held at a positive electrical potential, for example in the range of 0 to 1,500V, for example 1,500V. In this example, the surface (106) of the outer layer (105) of the ink transfer element (100) is electrically conductive and, in use, is held at an electrical potential which is less than the potential of the electrodes, for example a positive voltage such as 400V. In other examples the ink may be negatively charged, and the electrodes may be held at a negative voltage, for example −1,500V, and the ink transfer element surface may be held at a less negative voltage such as −400V.

The surface (106) of the ink transfer element may be energised using a connector, for example made of carbon, which may be electrically connected to the core structure (110) which in this example is metallic, such as aluminium, and which in turn may be connected to an electrical power supply. In examples where each porous layer on the core structure is formed of an electrically conductive material, the potential from the connector may therefore be transferred to the surface from the core structure by the layers.

The potential difference between the surface (106) and the ink supply electrodes (128) causes the charged ink to be electrostatically transferred from the ink inlet (126) to the surface (106) of the ink transfer element (100) via the electrodes (128); an arrow (122) illustrates the direction of the ink flow. Thus, the ink supply apparatus in this example uses electrostatic forces to supply ink to the ink transfer element (100). It is to be appreciated that an alternative ink supply apparatus could be used in other examples, such as that described later using FIG. 3. For example, the electrodes (128) may not be held at a potential; in such a further example, the ink may be transferred mechanically to the ink transfer element, without the use of electrostatic forces.

The speed of rotation of the ink transfer element (100) may be chosen in accordance with a rate of supply of the ink to achieve a uniform layer of ink on the surface (106). Further, by using the ink transfer element described in examples herein, application of ink from the ink supply electrodes to apply a uniform layer of ink on the ink transfer element may not need a tight tolerance between the electrodes and the surface, unlike known systems.

Ink transferred to the surface (106) in this way is at least partly separated by the surface into pigment particles, which remain on the surface (106), and liquid vehicle, which travels through the surface (106), towards the liquid collector, as indicated by the arrows (109) in the Figure. This leaves a layer of more solid ink on the surface (106).

The printing apparatus may be arranged to create a pressure difference across the surface (106) of the ink transfer element, with a greater pressure on a side of the surface (106) for receiving the ink than a pressure at an opposite side of the surface. This arrangement improves the separation of the liquid vehicle from the pigment particles in the ink. Such examples may therefore use reverse osmosis for the separation.

In this example, the potential difference between the electrodes (128) and the surface (106) of the ink transfer element (100) may be chosen such that the ink is transferred with sufficient force to the ink transfer element (100) such that a pressure difference between the side of the surface (106) facing the electrodes (128) and an opposite side of the surface (106) facing towards the center of the ink transfer element (100) is created, there being a lower pressure at the opposite side. In this way, the force of applying the ink to the surface assists the separation of the pigment particles from the liquid vehicle at the surface (106). In other examples, a pump may be used to supply ink to the surface (106) of the ink transfer element (100), with the force of pumping being used to create a pressure difference at the surface.

In addition, the BID for a printing apparatus may comprise a pressure roller (116), such as a squeegee roller, in contact with the surface (106) and for applying pressure to the surface (106) after initial separation of the liquid vehicle from the pigment particles has occurred when applying the ink to the ink transfer element (100). The application of pressure by the pressure roller (116) presses further liquid vehicle through the surface (106). The charged pigment particles remain in a layer on the surface (106) rather than being transferred to the pressure roller, by holding the surface (106) at an appropriate non-zero electrical potential in this example.

Further techniques may be used alternatively or additionally to assist separation of the pigment particles from the liquid vehicle. For example, a pressure difference may be created by lowering a pressure beneath the surface, i.e. at an underside of the surface (106) facing towards the center of the ink transfer element (100). This may be performed by using, for example, a suction pump connected to the drain of the liquid collector to draw liquid vehicle through the surface to the liquid collector and drain.

It will be appreciated that the extent of liquid vehicle separated by the surface may be controlled in dependence on the pore size of the surface and/or underlying layers and the magnitude of any pressure difference applied across the surface.

In this example, a squeezer roller (118) and a scraper (120) may be used to clean the surface. Such removed ink may flow towards an ink outlet (124), in a direction indicated by an arrow (117) in the figure, for collection and re-use or discarding. Additional rollers (not shown) may be arranged to clean the squeezer roller and/or to enhance cleaning of the ink transfer element.

In this example, after separating at least part of the liquid vehicle from the pigment particles, leaving a more solid layer of ink on the surface (106), the ink is transferred from the surface (106) to a further ink transfer element. An example of such a further ink transfer element is a photo-imaging cylinder. Thus, compared with known printing apparatus, the ink transfer element may replace a developer roller used to transfer ink to the photo-imaging cylinder. This arrangement provides a simple and effective mechanism for applying ink of suitable liquidity to the photo-imaging cylinder.

In alternative examples, the further ink transfer element may comprise a developer roller. In these examples, ink may be transferred from the ink transfer element to the developer roller and then to the photo-imaging cylinder; an example of this type is illustrated in FIG. 3, described below.

Figure 3:
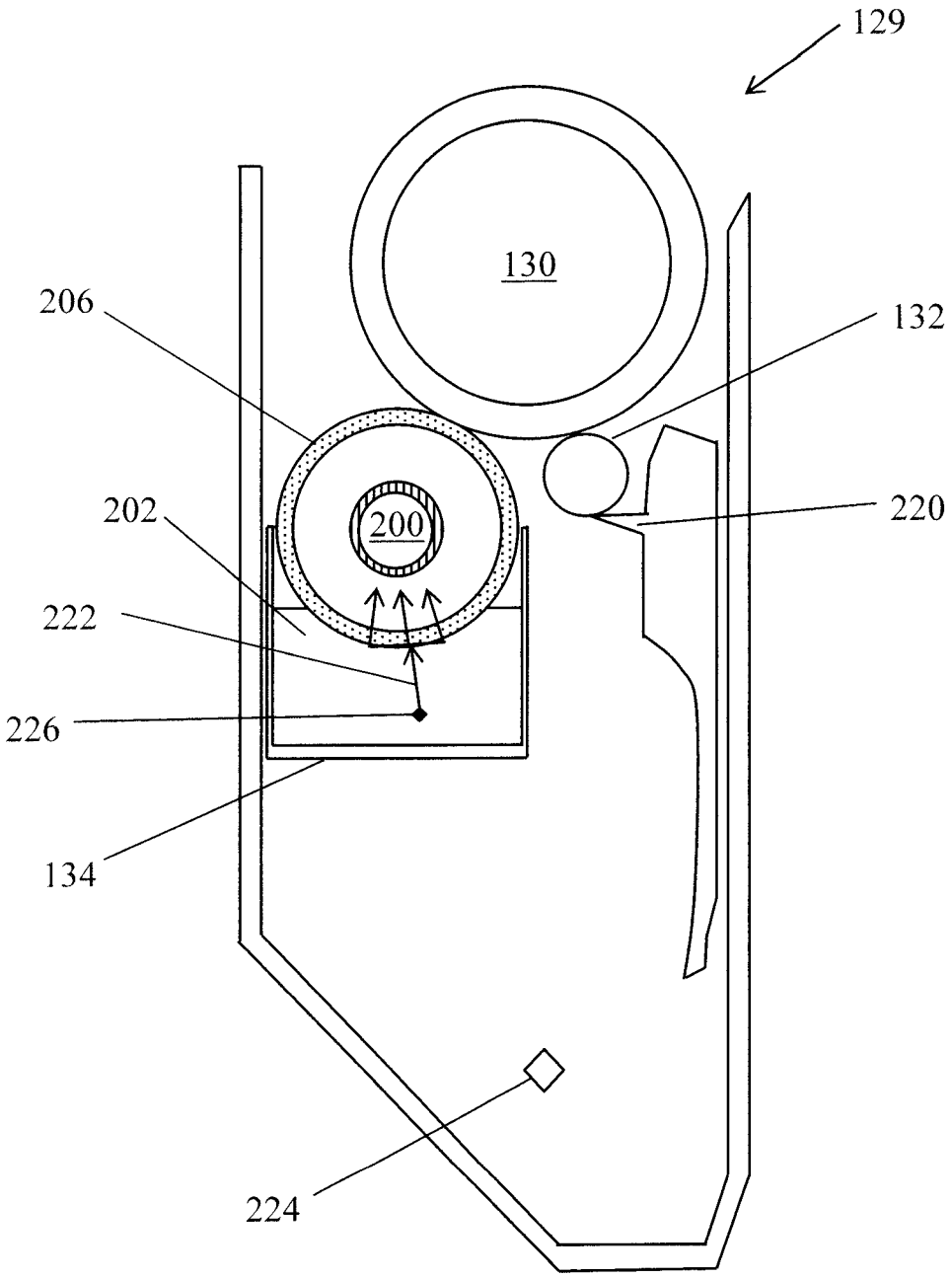
FIG. 3 shows schematically an illustrative BID comprising an ink transfer element in accordance with a further example.

FIG. 3 shows another illustrative binary ink developer (BID) (129) as part of an example of printing apparatus comprising an ink transfer element of examples described above. Features shown in FIG. 3 are similar to some of those described above; such features are labeled with the same reference numerals but prefixed with 200 rather than 100; corresponding descriptions should apply here also. In this example, the ink transfer element (200) is immersed at least partly in a reservoir (134) containing ink (202) received from an ink inlet (226). The ink inlet (226) and reservoir (134) is a further example of an ink supply apparatus arranged to supply ink to the ink transfer element. Ink from the reservoir (134) is transferred to the ink transfer element (200) as it rotates in the reservoir (134). In this example, compared with that of FIG. 2, it is not necessary to use electrostatic forces to supply ink from the ink reservoir (134) to the ink transfer element (200). This reduces the time the ink is exposed to electric fields, reducing ink fatigue. The surface may however be held at an electrical potential to assist in forming a layer of ink on the surface.

A pressure roller, such as that described above in relation to FIG. 2, but not illustrated here, may be arranged to apply pressure to the surface (206) to further separate the liquid vehicle from the pigment particles after the initial separation through the surface (206) has occurred. Further techniques to assist separation, such as those described above, may be used here also.

After the liquid vehicle has been at least partly separated from the pigment particles through the surface (206), the more solid ink is transferred to a further ink transfer element which, in this example, is a developer roller (130) arranged to receive ink from the surface (206). In this example, the surface (206) of the ink transfer element (200) is deformable. This allows a tight tolerance to be simply and easily achieved between the ink transfer element (200) and the developer roller (130), for effective ink transfer.

In some examples, at least one roller may be arranged to clean remaining ink from the surface of the ink transfer element (200). For example, a cleaner roller and wiper (not shown) may be used. Further, a cleaner roller (218) may be used to clean the developer roller (130); ink may be wiped from the cleaner roller by a wiper (220) and may flow towards and out of the ink outlet (224), where it may be recycled or discarded.

In this example, once the ink has been transferred to the developer roller (130) the ink may then be transferred to at least one further ink transfer element, such as a photo-imaging cylinder, for transferring ink thereafter to a print medium (not shown).

FIG. 4 is a diagram of an illustrative example of printing apparatus which may be used to perform a method of printing using printing apparatus comprising an ink transfer element described above, the method including: a) applying an ink comprising pigment particles and a liquid vehicle to the surface of the ink transfer element; b) removing at least part of the liquid vehicle from the applied ink, through the surface, thereby providing a more solid ink on the surface; and c) transferring the more solid ink to at least one further ink transfer element for applying to a print medium.

The illustrative example printing apparatus (138) shown in FIG. 4 is a digital Liquid Electro Photographic (LEP) printing apparatus, which is an example of a digital offset printing apparatus, and which comprises an ink transfer element described above. The term "Liquid Electro Photographic" or "LEP" refers to a process of printing in which a pattern of electrostatic charge is used to form a pattern of ink, corresponding with the electrostatic charge pattern, on the surface of a photo-imaging cylinder. These ink images are transferred to a heated blanket cylinder, which heating evaporates a liquid vehicle, and then to a print medium. The photo-imaging cylinder continues to rotate, passing through various stations to form the next image.

In the illustrative digital LEP printing apparatus (136), the desired image is communicated to the printing apparatus (136) in digital form. The desired image may include any combination of text, graphics and images. The desired image is initially formed on the photo-imaging cylinder (140), transferred to a blanket (142) on the outside of the blanket cylinder (144), and then transferred to the print medium (146). The blanket (142) may otherwise be referred to as an intermediate transfer member (ITM).

According to one illustrative example, an image is formed on the photo-imaging cylinder (140) by rotating a clean, bare segment of the photo-imaging cylinder (140) under the photo charging unit (138). The photo charging unit (138) includes a charging device such as corona wire, charge roller, or other charging device and a laser imaging portion. A uniform static charge is deposited on the photo-imaging cylinder (140) by the photo charging unit (138). As the photo-imaging cylinder (140) continues to rotate, it passes the laser imaging portion of the photo charging unit (138) that dissipates the static charges in selected portions of the image area to leave an invisible electrostatic charge pattern that represents the image to be printed.

Ink is transferred onto the photo-imaging cylinder (140) by BID units (135). In this example, there is one BID unit (135) for each ink color. During printing, the appropriate BID unit is engaged with the photo-imaging cylinder (140). The engaged BID unit presents a uniform film of ink to the photo-imaging cylinder (140). The ink contains electrically charged pigment particles which are attracted to the opposing electrical fields on the image areas of the photo-imaging cylinder (140). The ink is repelled from the uncharged, non-image areas. The photo-imaging cylinder (140) now has a single color ink image on its surface.

The photo-imaging cylinder (140) continues to rotate and transfers the ink image to the ITM (142) of the blanket cylinder (144) which is heatable. The blanket cylinder transfers the image from the ITM to a sheet of media wrapped around an impression cylinder (150). In other examples the media may be web fed. This process may be repeated for each of the colored ink layers to be included in the final image.

The print medium (146) enters the printing apparatus (136) from the right, passes over a feed tray (152), and is wrapped onto the impression cylinder (150). The print medium may have been pre-printed with a primer. As the print medium (146) contacts the ITM (142) of the blanket cylinder (144), the single color ink image is transferred to the print medium (146). The creation, transfer, and cleaning of the photo-imaging cylinder (140) is a continuous process, with hundreds of images being created and transferred per minute.

To form a single color image (such as a black and white image), one pass of the print medium (146) through the impression cylinder (150) and the blanket cylinder (144) completes the desired image. For a color image, the print medium (146) is retained on the impression cylinder (150) and makes multiple contacts with the blanket cylinder (144) as it passes through the nip (148). At each contact, an additional color plane may be placed on the print medium (146). The term nip refers to a region between two rollers where the rollers are in closest proximity. When a media sheet or other material passes through the nip, the distance between the two rollers can be adjusted to produce pressure on the media.

For example, to generate a four color image, the photo charging unit (138) forms a second pattern on the photo-imaging cylinder (140) which receives the second ink color from a second BID unit (135). As described above, this second ink pattern is transferred to the ITM (142) and impressed onto the print medium (146) as it continues to rotate with the impression cylinder (150). This continues until the desired image with all four color planes is formed on the print medium. Following the complete formation of the desired image on the print medium (146), the print medium (146) can exit the machine or be duplexed to create a second image on the opposite surface of the print medium (146). In other examples, where the print medium is web fed, all colors of an image may be provided onto the ITM and transferred to the print medium in one rotation of the ITM. Because the printing apparatus is digital, the operator can change the image being printed at any time and without manual reconfiguration.

In this example, at least one of the BID units (135) of the printing apparatus just described comprises an ink transfer element as described above in examples, which is configured to at least partly separate liquid vehicle from pigment particles, through the surface. At least one BID unit (135) may be one of the BID units (114, 129) described above using FIG. 2 or 3.

Examples have been described comprising an ink transfer element (200) with a surface configured to at least partly separate liquid vehicle from pigment particles through the surface (206), leaving a layer of more solid ink on the surface. Reducing the liquidity of the ink in this way improves the quality of the final printed image more effectively and cleanly than known printers which may use a squeegee roller to reduce the liquidity of the ink to a limited degree.

The preceding description has been presented only to illustrate and describe examples of the principles described. This description is not intended to be exhaustive or to limit these principles to any precise form disclosed. Many modifications and variations are possible in light of the above teaching.

The invention claimed is:

1. An ink transfer element for a printing apparatus, the ink transfer element comprising a surface for transferring ink applied thereto to at least one further ink transfer element, wherein the surface is configured to, when an ink comprising pigment particles and a liquid vehicle is applied to the surface, at least partly separate the liquid vehicle from the pigment particles, through the surface.

2. An ink transfer element according to claim 1, wherein the surface is deformable.

3. An ink transfer element according to claim 1, wherein the surface is electrically conductive.

4. An ink transfer element according to claim 1, wherein the surface is an outer surface of a porous layer.

5. An ink transfer element according to claim 4, wherein the porous layer is a metallic mesh layer, a carbon fiber fabric layer, an electrically conductive coating, or an electrically conductive sponge layer.

6. An ink transfer element according to claim 4, wherein a pore size of the porous layer is 50 microns or less.

7. An ink transfer element according to claim 1, wherein the ink transfer element is a roller.

8. An ink transfer element according to claim 1, comprising a liquid collector arranged to collect liquid vehicle separated at the surface and having passed through at least one layer underlying the surface.

9. An ink transfer element according to claim 8, comprising a drain for draining collected liquid vehicle from the liquid collector.

10. Printing apparatus comprising an ink transfer element comprising a surface for transferring ink applied thereto to at least one further ink transfer element, wherein the surface is configured to, when an ink comprising pigment particles and a liquid vehicle is applied to the surface, at least partly separate the liquid vehicle from the pigment particles, through the surface, the printing apparatus comprising an ink supply apparatus for supplying ink to the ink transfer element and at least one further ink transfer element arranged to receive ink from the surface.

11. Printing apparatus according to claim 10, arranged to create a pressure difference across the surface of the ink transfer element, with a greater pressure on a side of the surface for receiving an ink than a pressure at an opposite side of the surface.

12. Printing apparatus according to claim 10, wherein the ink supply apparatus is arranged to use electrostatic forces to supply ink to the ink transfer element.

13. Printing apparatus according to claim 10, wherein the at least one further ink transfer element comprises a developer roller arranged to receive ink from the surface.

14. Printing apparatus according to claim 10, comprising a pressure roller in contact with the surface and arranged to apply pressure to separate further liquid vehicle from the pigment particles of the ink when applied to the surface.

15. A method of printing using printing apparatus comprising an ink transfer element, the ink transfer element comprising a surface for transferring ink applied thereto to at least one further ink transfer element, the surface being configured to, when an ink comprising pigment particles and a liquid vehicle is applied to the surface, at least partly remove the liquid vehicle from the pigment particles, through the surface, the method comprising:

a) applying an ink comprising pigment particles and a liquid vehicle to the surface of the ink transfer element;

b) removing at least part of the liquid vehicle from the applied ink, through the surface, thereby providing a more solid ink on the surface; and c) transferring the more solid ink to at least one further ink transfer element for applying to a print medium.

* * * * *